US005674019A

United States Patent [19]

Munakata et al.

[11] Patent Number: 5,674,019

[45] Date of Patent: Oct. 7, 1997

[54] IMAGE FORMING APPARATUS, AND METHOD THEREOF

[75] Inventors: Atsushi Munakata; Jun Horikoshi, both of Yokohama, Japan

[73] Assignee: Canon Kabushiki Kaisha, Tokyo, Japan

[21] Appl. No.: 588,284

[22] Filed: Jan. 18, 1996

Related U.S. Application Data

[63] Continuation of Ser. No. 137,481, Oct. 18, 1993, abandoned.

[30] Foreign Application Priority Data

Nov. 2, 1992 [JP] Japan ..... 4-294248

[51] Int. Cl.[6] ..... B41J 19/92

[52] U.S. Cl. ..... 400/568; 400/571; 400/703

[58] Field of Search ..... 400/545, 550, 400/551, 554, 568, 571, 703, 708

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,893,951 | 1/1990 | Iwatani et al. | 400/236 |
| 5,131,770 | 7/1992 | Kanemitsu | 400/568 |
| 5,297,871 | 3/1994 | Fujioka | 400/568 |

FOREIGN PATENT DOCUMENTS

| | | | |
|---|---|---|---|
| 54-56847 | 5/1979 | Japan . | |
| 59-123670 | 7/1984 | Japan . | |
| 59-138461 | 8/1984 | Japan . | |
| 60-71260 | 4/1985 | Japan . | |
| 274969 | 12/1986 | Japan | 400/568 |

*Primary Examiner*—Ren Yan

*Attorney, Agent, or Firm*—Fitzpatrick, Cella, Harper & Scinto

[57] ABSTRACT

In a serial page printer for printing an image line by line by scanning a printing head, even if a motor for driving a roller for conveying a printing medium is rotated by a predetermined amount, the printing medium is not conveyed by a predetermined amount depending on decentering of the roller, the position of the printing medium, and the like, resulting in a printing error. In order to prevent this, a predetermined position of the roller is brought into contact with each line of a printing medium. For this purpose, an apparatus of the present invention detects that the position of the printing medium and the state of the roller are in a predetermined state. Therefore, a line subjected to printing and the state of the roller have a predetermined relationship on any page, and the printing medium can be conveyed by a predetermined amount for each line by adjusting the rotational amount of the roller for each line in advance.

48 Claims, 14 Drawing Sheets

FIG. 3

| NUMBER OF CONVEY OPERATIONS OF RECORDING MEDIUM | STATE OF RECORDING MEDIUM | ROLLER GOVERNING CONVEY AMOUNT |
|---|---|---|
| 1~2 | HELD BY CONVEY ROLLER 1 | CONVEY ROLLER 1 |
| 3 | LEADING END IS BROUGHT INTO CONTACT WITH DISCHARGER ROLLER 3 | CONVEY ROLLER 1 |
| 4~9 | HELD ON TWO ROLLERS | CONVEY ROLLER 1 |
| 10 | TRAILING END IS SEPARATED FROM CONVEY ROLLER 1 | CONVEY AND DISCHARGER ROLLERS 1 AND 3 |
| 11~12 | HELD ON DISCHARGE ROLLER 3 | DISCHARGER ROLLER 3 |

FIG. 5A

| NUMBER OF CONVEY OPERATIONS OF RECORDING MEDIUM | 1 | 2 | 3 | 4 | 5 | 6 |
|---|---|---|---|---|---|---|
| CONVEY MOTOR DRIVE PULSE | 2000 | 2000 | 2000 | 2000 | 2000 | 2000 |
| DISCHARGE MOTOR DRIVE PULSE | 0 | 0 | 0 | 2040 | 2040 | 2040 |
| DIFFERENCE (MEAN VALUE) BETWEEN DESIRED CONVEY AMOUNT AND MEASUREMENT VALUE | -15μm | -6μm | -1μm | -11μm | 0μm | -8μm |

FIG. 5B

| NUMBER OF CONVEY OPERATIONS OF RECORDING MEDIUM | 7 | 8 | 9 | 10 | 11 | 12 |
|---|---|---|---|---|---|---|
| CONVEY MOTOR DRIVE PULSE | 2000 | 2000 | 2000 | 0 | 0 | 0 |
| DISCHARGE MOTOR DRIVE PULSE | 2040 | 2040 | 2040 | 2000 | 2000 | 2000 |
| DIFFERENCE (MEAN VALUE) BETWEEN DESIRED CONVEY AMOUNT AND MEASUREMENT VALUE | -14μm | -5μm | -4μm | -37μm | -30μm | -28μm |

FIG. 5C

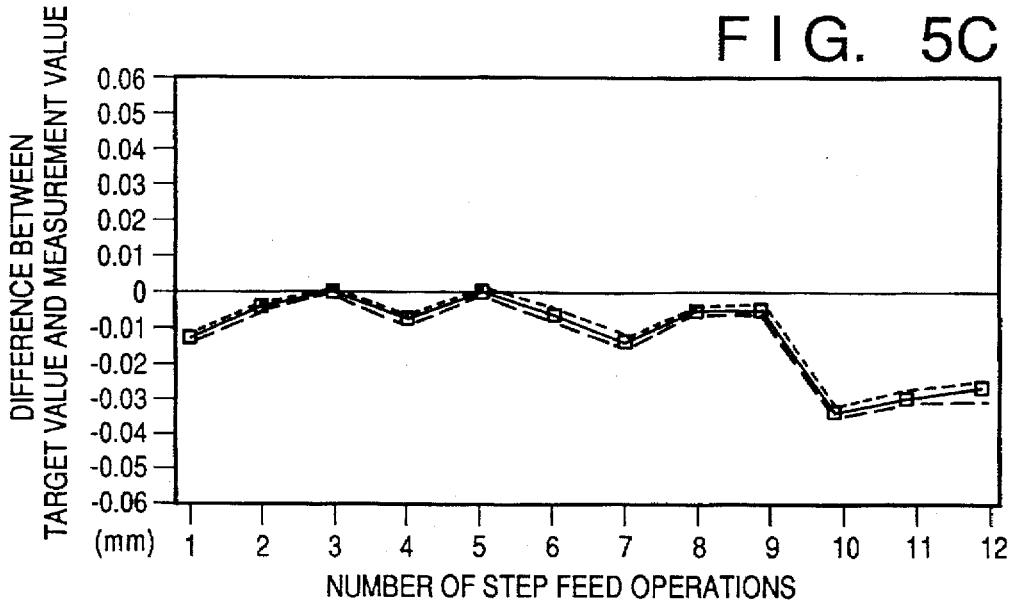

FIG. 6A

| NUMBER OF CONVEY OPERATIONS OF RECORDING MEDIUM | 1 | 2 | 3 | 4 | 5 | 6 |
|---|---|---|---|---|---|---|
| CONVEY MOTOR DRIVE PULSE | 2002 | 2001 | 2000 | 2001 | 2000 | 2001 |
| DISCHARGE MOTOR DRIVE PULSE | 0 | 0 | 0 | 2040 | 2040 | 2040 |
| DIFFERENCE (MEAN VALUE) BETWEEN DESIRED CONVEY AMOUNT AND MEASUREMENT VALUE | -1μm | +3μm | +2μm | -5μm | +8μm | -1μm |

FIG. 6B

| NUMBER OF CONVEY OPERATIONS OF RECORDING MEDIUM | 7 | 8 | 9 | 10 | 11 | 12 |
|---|---|---|---|---|---|---|
| CONVEY MOTOR DRIVE PULSE | 2002 | 2001 | 2000 | 0 | 0 | 0 |
| DISCHARGE MOTOR DRIVE PULSE | 2040 | 2040 | 2040 | 2005 | 2004 | 2003 |
| DIFFERENCE (MEAN VALUE) BETWEEN DESIRED CONVEY AMOUNT AND MEASUREMENT VALUE | +3μm | +4μm | -5μm | +10μm | +6μm | +3μm |

FIG. 6C

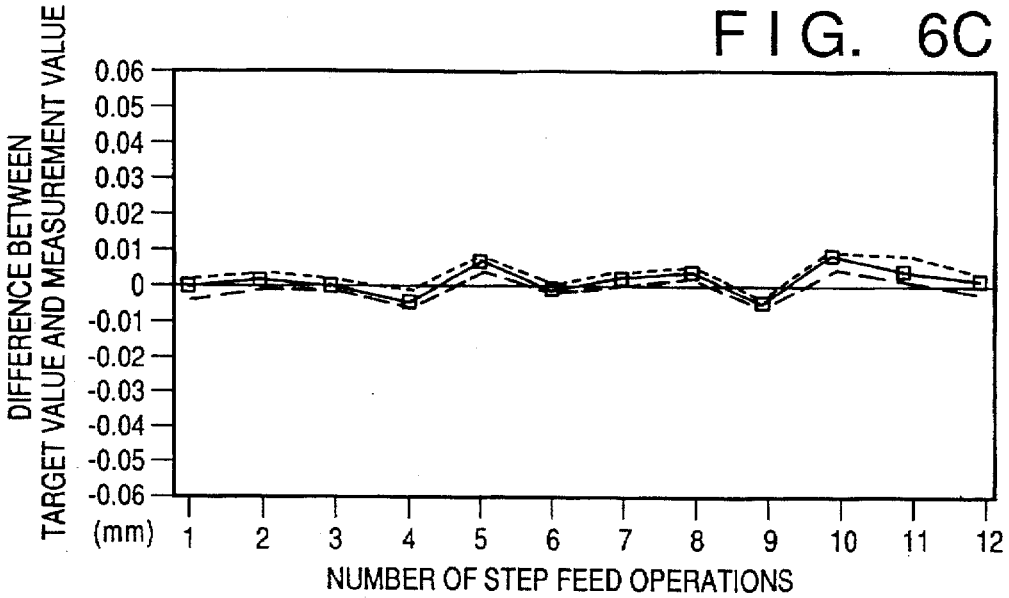

IMAGE FORMING APPARATUS, AND METHOD THEREOF

This application is a continuation of application Ser. No. 08/137,481, filed Oct. 18, 1993, now abandoned.

BACKGROUND OF THE INVENTION

1. Field of the Invention

The present invention relates to an image forming apparatus and method for forming an image in accordance with, e.g., an input image signal or a document to be read.

2. Prior Art

Printer apparatuses using various image forming means have been put into practical use. Of these means, an ink-jet scheme, a thermal transfer scheme, and the like are widely used, ranging from personal printers to office printers, because they allow a reduction in size and noise at a relatively low cost.

In image forming apparatuses using these printing schemes, image formation is generally performed while a print medium such as a paper sheet is moved relative to an internal printing section. In a serial scan printer using the ink-jet scheme or the like, a printing medium is intermittently fed step by step a predetermined amount at a time, and an image is formed the predetermined amount at a time. A printing medium is generally conveyed by a convey roller, a drive unit, e.g., a pulse motor, for driving the convey roller, and a drive transmission means such as pulleys, gears, and belt, for transmitting driving force.

In the printing scheme for forming an image while intermittently moving a printing medium relative to the printing section in the apparatus, the printing medium must be accurately conveyed line by line a predetermined amount at a time. If the printing medium is fed by an amount smaller than the predetermined amount, image overlapping occurs to form black stripes. In contrast to this, if the medium is fed by an amount exceeding the predetermined amount, image discontinuity occurs to form white stripes. In addition, such a lack or excess of convey amount also causes color misregistration, resulting in a considerable deterioration in image quality.

The main causes that make it difficult to accurately convey a printing medium line by line a desired convey amount at a time are the decentering of a printing medium convey roller and of a drive transmission means such as pulleys and gears, fluctuations in the speed of a drive source, the gear cutting precision of, e.g., belts, pulleys, and gear, and the like. Of these causes, the decentering of the roller for conveying a printing medium or of pulleys has the greatest influence.

In order to solve this problem, a conventional printer apparatus is set such that a printing medium is conveyed by a convey amount corresponding to one line when each decentered element such as a roller or a pulley is rotated one time or a plurality (integer) of times, thereby reducing variations in convey amount corresponding to one line owing to decentering.

Consider, for example, the convey roller. If, for example, a printing medium is to be conveyed by an amount corresponding to one line per rotation, the actual convey amount deviates from a predetermined amount unless the roller is processed to have an accurate diameter. In a general printer apparatus, the print width of the print head is about several mm to a few cm. In this case, the diameter of the convey roller is about several mm, which is very small as compared with its length, resulting in deflection, warpage, or the like.

Under the circumstances, therefore, a printer apparatus is reluctantly set such that a printing medium is conveyed by a convey amount corresponding to an integer multiple of a convey amount corresponding to one line when the convey roller is rotated once, thereby canceling variations in convey amount due to the decentering of the roller with a convey operation corresponding to several lines. In this method, however, the convey amount varies for each line to some degree. That is, the method is not very effective. In addition, from the viewpoint of the overall system, it is difficult to completely cancel variations in convey amount corresponding to one line owing to the influence of each element because, the relative positional relationship between the drive transmission means (belts and pulleys) and the convey roller varies depending on a printing medium used. Furthermore, it takes much labor and cost to process a recording convey roller, pulleys, and the like with high precision, and hence the cost is inevitably increased.

SUMMARY OF THE INVENTION

The present invention has been made to solve the above-described problem in the prior art, and has as its object to provide an image forming apparatus which can always form a high-definition image at a low cost without using a complicated mechanism.

It is another object of the present invention to provide an image forming apparatus for forming an image on a printing medium line by line by a serial scheme, comprising:

convey means for conveying the printing medium during an image forming operation;

setting means for setting a predetermined relationship between a state of the convey means and a position of the printing medium;

storage means for storing drive amount data of the convey means in units of the lines;

drive means for driving the convey means in accordance with the drive amount data stored in the storage means, on the basis of the relationship set by the setting means; and print means for printing an image on the printing medium line by line.

Preferably, the convey means is a roller, and conveyance of a predetermined amount can always be performed even if the roller is decentered, thereby forming a high-definition image.

The printing medium is divided into pages, and conveyance of a predetermined amount can always be performed for each line on each page.

The setting means sets a predetermined relationship between the printing medium, the roller, a pulley, and a belt, and can restrict not only the decentering of the roller but also a convey amount error caused by the pulley and the belt.

A predetermined image pattern is printed and read, and a convey amount error for each line can be calculated and corrected.

It is still another object of the present invention to provide an image forming apparatus in which at least one roller is pressed against a printing medium, and an image is formed line by line by a printing head while the printing medium is conveyed by rotation of the roller, comprising:

drive means for driving the roller;

means for detecting that the roller is located at a predetermined angular position;

storage means for storing drive amount data of the drive means line by line to convey a printing medium having a predetermined length;

means for controlling rotation of the roller through the drive means on the basis of the drive amount data stored in the storage means; and means for controlling rotation of the roller to set the roller at the predetermined angular position before image formation on the printing medium is started.

It is still another object of the present invention to provide a method of controlling a serial printer for printing an image line by line, comprising the steps of:

setting a roller for conveying a printing medium at a predetermined angular position;

detecting that the printing medium is located at a predetermined position;

printing an image line by line; and conveying the printing medium by rotating the roller by a predetermined amount stored in a memory every time one-line recording is performed.

With the above-described arrangement, the image forming apparatus of the present invention can always form a high-definition image at a low cost without using a complicated mechanism.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a chart showing rollers for governing the convey amount of a printing medium for each line in the image forming apparatus of the embodiment;

FIGS. 5A to 5C are charts showing the number of drive pulses, as an initial value, for a motor and the corresponding convey amount of a printing medium for each line in the image forming apparatus of the embodiment;

FIGS. 6A to 6C are charts showing the number of drive pulses for a motor and the corresponding convey amount of a printing medium for each line during an actual operation of the image forming apparatus of the embodiment;

DETAILED DESCRIPTION OF THE PREFERRED EMBODIMENTS (First Embodiment)

Figure 1:
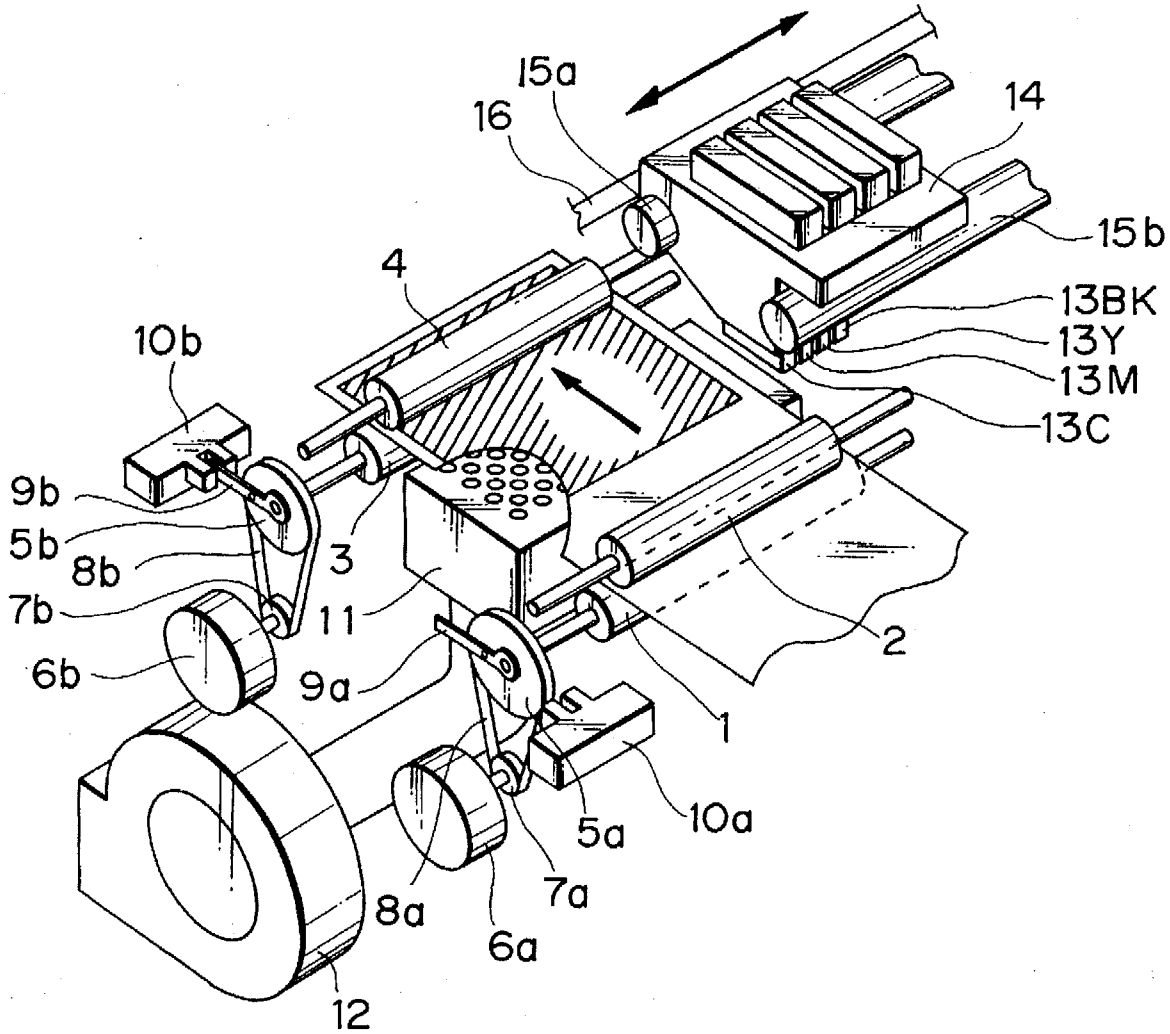
FIG. 1 is a perspective view showing an image forming section of an image forming apparatus according to an embodiment of the present invention.
Figure 2:
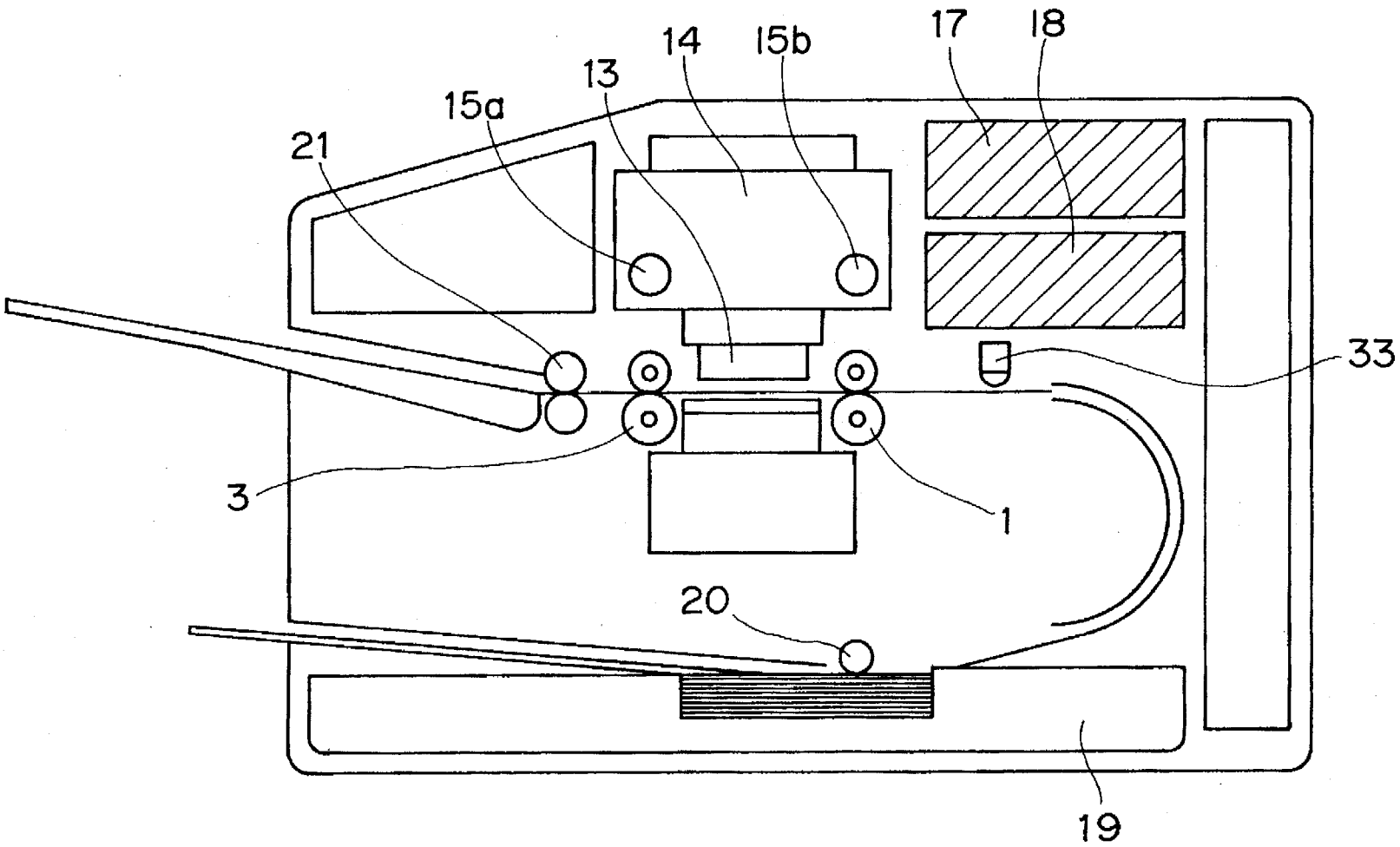
FIG. 2 is a sectional view showing a main part of the image forming apparatus of the embodiment.

FIG. 1 is a perspective view showing a printing section of an ink-jet printer to which the present invention is applied. FIG. 2 is a sectional view showing a main part of the apparatus. This printer prints images in units of pages.

<Arrangement of the Apparatus>

Referring to FIG. 1, a convey roller 1 and a driven roller 2 for pressing a printing medium against the roller 1 are disposed on the upstream side (the lower right side in FIG. 1) of a printing section. Similarly, a discharge roller 3 and a driven roller 4 for pressing the printing medium against the roller 3 are disposed on the downstream side (the upper left side in FIG. 1) of the printing section.

Each of pulleys 5*a* and 5*b* is mounted on one end of a corresponding one of the convey and discharge rollers 1 and 3. The convey and discharge rollers 1 and 3 are respectively driven by pulse motors 6*a* and 6*b* through motor pulleys 7*a* and 7*b* and timing belts 8*a* and 8*b* meshed with the respective pulleys.

Each of the pulse motors 6*a* and 6*b* used in this embodiment is a high-resolution five-phase stepping motor having a basic step angle of 0.36° and half-step-driven (0.18° per pulse) by a motor driver (not shown). Note that in FIG. 1, the ratio of the number of gear teeth of each of the pulleys 5*a* and 5*b* respectively mounted on the convey and discharge rollers 1 and 3 to that of a corresponding one of the motor pulleys 7*a* and 7*b* is set to be 3:1.

Flags 9*a* and 9*b* are respectively attached to the pulleys 5*a* and 5*b* mounted on the respective drive roller ends. These flags 9*a* and 9*b* respectively interrupt photointerrupters 10*a* and 10*b* arranged on the apparatus main body side to detect predetermined rotational displacements of the pulleys 5*a* and 5*b*.

A platen 11 serves to support a printing medium at the printing section and has a large number of small holes in a printing medium passing surface to prevent the printing medium from floating during an image printing operation. The platen 11 is connected to a suction blower 12.

A print head 13 is a head of an ink-jet scheme. In the embodiment, in order to form a full-color image, four color print heads, i.e., cyan, magenta, yellow, and black print heads 13C, 13M, 13Y, and 13Bk are disposed side by side in the scanning direction of the print head 13. Each head has 256 nozzles arranged in a line, from which ink particles are discharged to print an image having a width of 16.25 mm. Note that print heads 13C, 13M, 13Y, and 13Bk will be referred to as the print head 13 as a whole.

In the apparatus of the embodiment, the print width of one line is set to be ⅓ the circumference of the convey roller 1 and the discharge roller 3. Since the print width corresponds to one rotation of the motor pulleys 7*a* and 7*b*, the process precision of the motor pulleys 7*a* and 7*b* has no influence on the print precision.

The print head 13 scans on guide rails 15*a* and 15*b* mounted on a carriage 14 in a direction perpendicular to the convey direction of a printing medium. The carriage 14 is driven by a pulse motor (not shown) through a drive belt 16.

Referring to FIG. 2, a CPU 17 controls a driving operation of each motor. A memory 18 stores the number of drive pulses input to each motor in an image forming operation for each line.

In the embodiment, the ratio of the pressure of the driven roller 2 against the convey roller 1 to the pressure of the driven roller 4 against the discharge roller 3 is set to be about 4:1. In addition, it takes a convey operation corresponding to 10 lines for the trailing end of a printing medium passes through the convey roller 1 and the driven roller 2 after the leading end of the printing medium is caught therebetween, and a convey operation corresponding to two more lines is required to separate the trailing end from the discharge roller 3.

For this reason, as shown in FIG. 3, the convey amount of a printing medium is governed by the convey roller 1 in the interval between the instant at which the printing medium is caught by only the convey roller 1 and the instant immediately before a convey operation of separating the trailing end of the printing medium from the convey roller 1 (first to ninth convey operations). During a convey operation (10th convey operation) of separating the trailing end of the printing medium from the convey roller 1, the convey amount of the printing medium is influenced by both the convey roller 1 and the discharge roller 3. During convey operations (11th and 12th convey operations) in which the printing medium is caught by only the discharge roller 3, the convey amount of the printing medium is governed by the discharge roller 3. Note that the above-mentioned convey operation counts are based on the assumption that an A4-size printing medium is conveyed transversely (the same will apply hereinafter).

Figure 4:
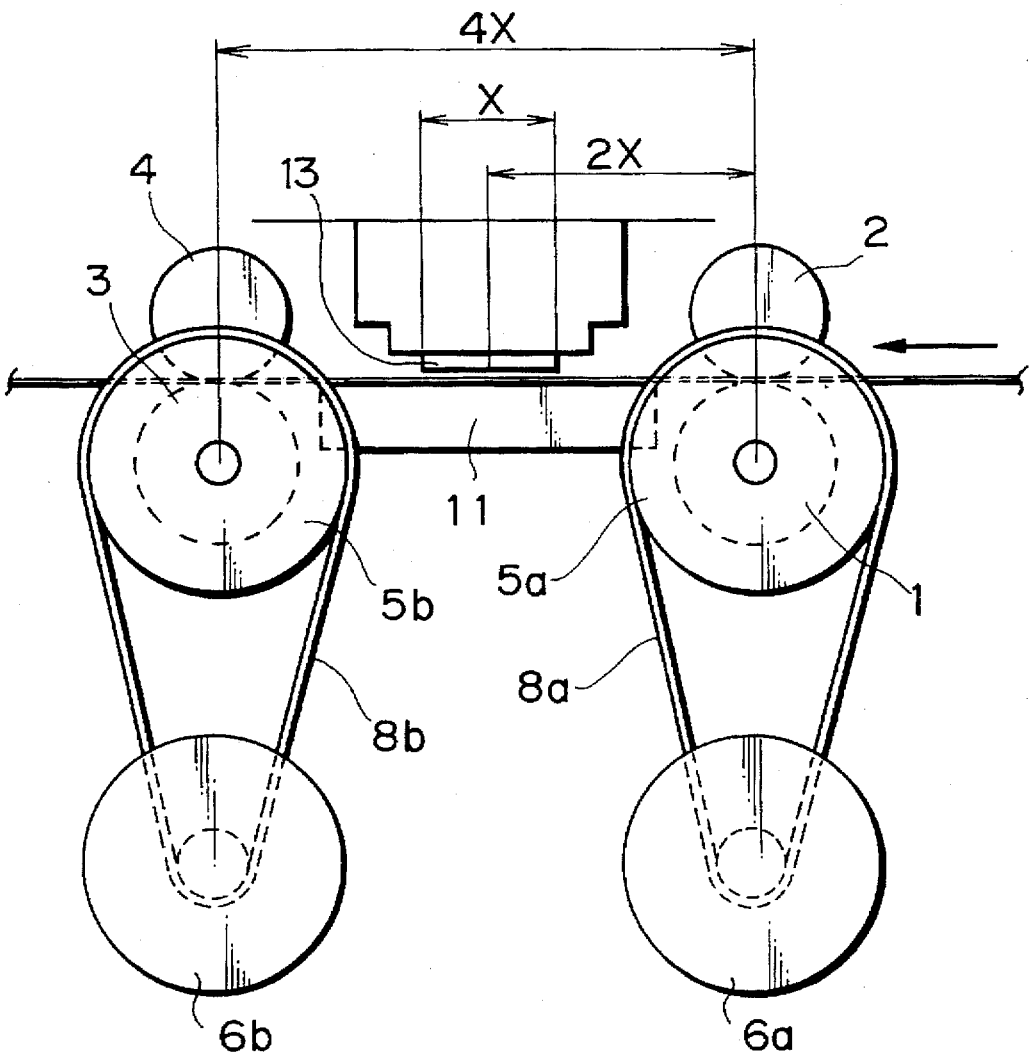
FIG. 4 is a view showing the dimensions of the image forming section of the image forming apparatus of the embodiment.

FIG. 4 shows the dimensions of the cross-section of a main part of an image forming section of the apparatus of the embodiment.

As shown in FIG. 4, the distance between the axes of the convey and discharge rollers 1 and 3 is set to be four times larger than a print width×(16.256 mm). Both the distances between the centers of the convey and discharge rollers 1 and 3 and the center of the print head 13 are 2×.

In this apparatus, therefore, when a printing medium is conveyed after image formation corresponding to the second line is completed, the leading end of the printing medium reaches the discharge roller 3. When a convey operation is performed once more after the trailing end of the printing medium is separated from the convey roller 1, image formation corresponding to the last line is performed.

<Image Forming Operation>

Figure 7:
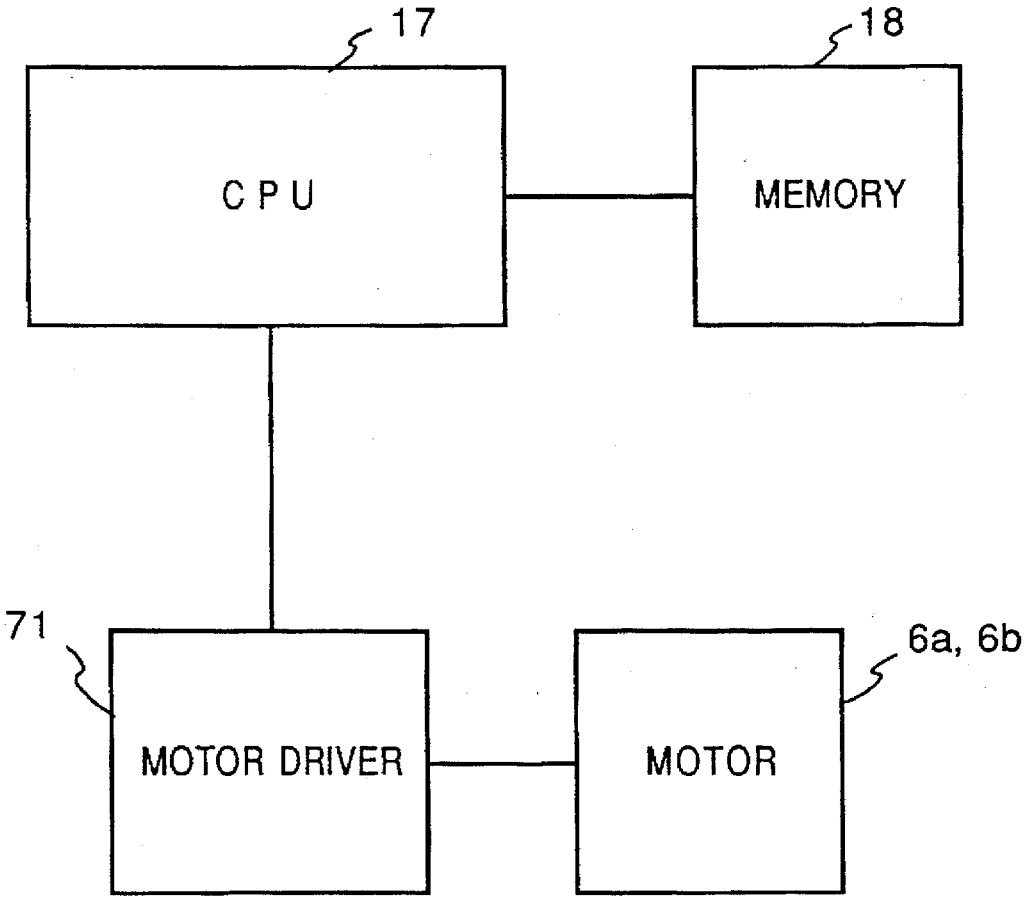
FIG. 7 is a block diagram showing a motor control mechanism of the printer of the embodiment.
Figure 8:
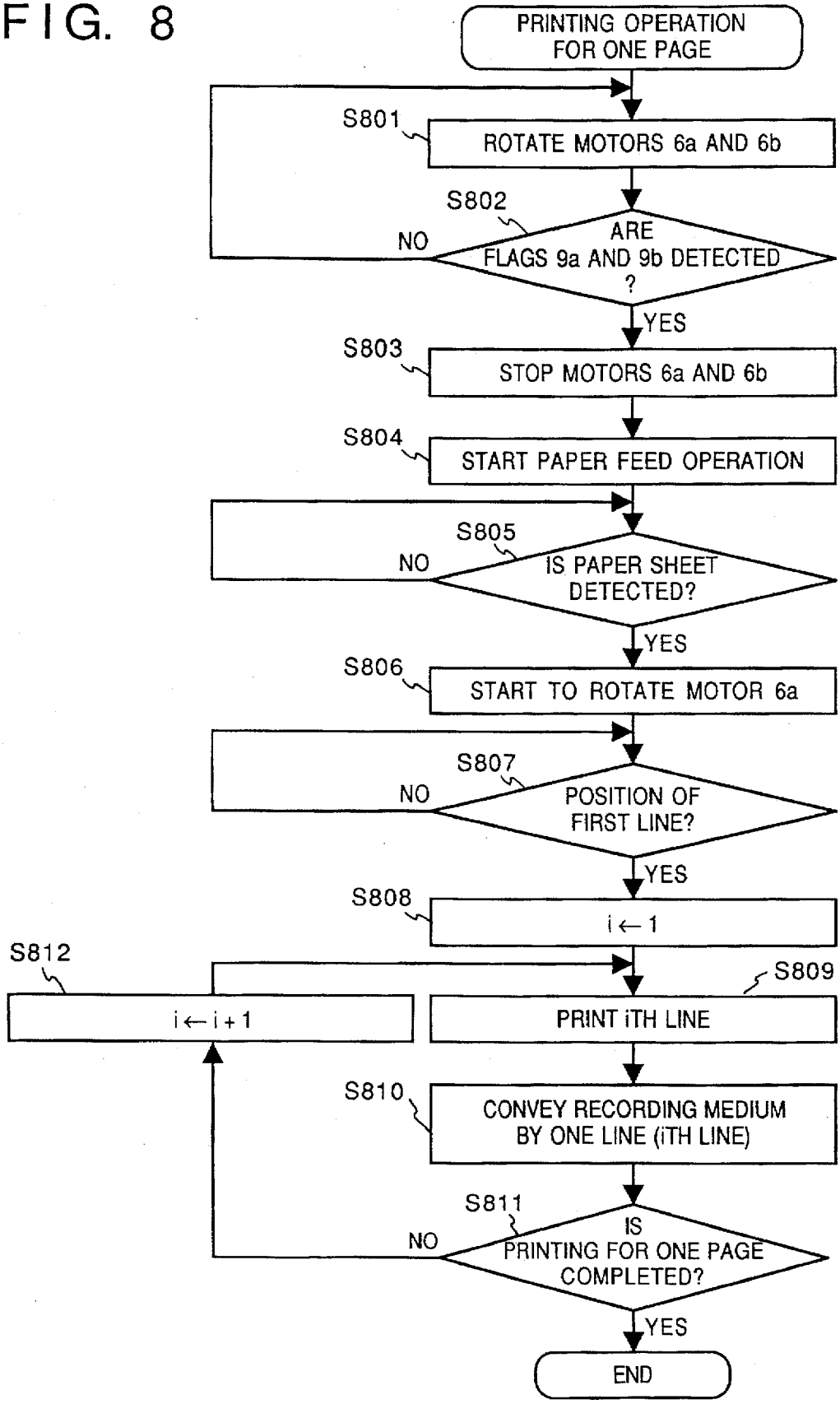
FIG. 8 is a flow chart showing a sequence of printing an image on one page.

An operation to be performed when an image is formed on a printing medium by the apparatus of the embodiment will be described next. FIG. 8 is a flow chart showing an image forming operation to be performed under the control of the CPU 17 in the arrangement shown in FIGS. 1, 2, and 7.

Before an image forming operation is started, the pulse motors 6*a* and 6*b* are driven to rotate the convey and discharge rollers 1 and 3 in step S801. The convey and discharge rollers 1 and 3 are rotated counterclockwise until the flags 9*a* and 9*b* on the pulleys 5*a* and 5*b* mounted on the end portions of the respective rollers interrupt light beams from the photointerrupters 10*a* and 10*b*. In step S802, the points of time at which light beams from the photointerrupters 10*a* and 10*b* are respectively interrupted by the flags 9*a* and 9*b* are detected. In step S803, the pulse motors 6*a* and 6*b* for driving the convey and discharge rollers 1 and 3 are stopped, excited, and held in the excited state under the control of the CPU 17.

Even if light beams from the photointerrupters 10*a* and 10*b* have already been interrupted by the flags 9*a* and 9*b* at the start of the above-mentioned operation, the same operation as described above is performed.

In step S804, feeding of a paper sheet is started. Referring to FIG. 2, the leading end of the printing medium fed from a cassette 19 by a paper feed unit 20 is detected by a timing sensor 33 in step S805. As the sensor 33, a photointerrupter is used. In step S806, the motor 6*a* is driven. At this point of time, the convey roller 1 starts to rotate and holds the printing medium, thus conveying the printing medium to an image formation start position for the first line.

Since the above-described operation is performed at the start of image formation for each printing medium, the relationship between an image formation position on a printing medium and the rotational displacement of the convey roller 1 is kept constant.

When the leading end of the printing medium is held by the convey roller 1 and reaches the image formation start position for the first line, the carriage 14 having the print head 13 mounted thereon scans on the guide rails 15*a* and 15*b* to form a first-line image on the printing medium in step S809.

In step S810, the CPU 17 sends a control signal to a motor driver (not shown) to drive each pulse motor in accordance with information on a first-line drive pulse count stored in the memory 18 in advance. The convey roller 1 makes ⅓ rotation through the timing belts 8*a* and 8*b* to convey the printing medium by an amount equal to the print width of one line. When the above-described operation is repeated, and printing for the second line is completed, the printing medium is conveyed by the convey roller 1. In the subsequent convey operations for the printing medium, the discharge roller 3 is also driven. The leading end of the printing medium then reaches the discharge roller 3 and held by the discharge roller 3. That is, the relationship between an image formation position on a printing medium and the rotational displacement of the discharge roller 3 is also kept constant.

Note that steps S808 and S812 in FIG. 8 are added to repeat the sequence and are set for the sake of convenience. Although a paper feed operation is started in step S804, this operation may be performed before or after step S801.

Subsequently, the above-described operation is repeated to perform image formation line by line. In order to prevent floating and creasing of a printing medium on the platen 11, the number of drive pulses supplied to the discharge roller 3 is set to be slightly larger than that of drive pulses supplied to the convey roller 1 (larger in convey amount by 2% in this embodiment). The amounts of rotation of the convey and discharge rollers 1 and 3 for each line are controlled by the pulse motors 6*a* and 6*b* for driving the respective rollers, which motors are driven by the motor drivers controlled by control signals supplied from the CPU 17 on the basis of drive pulse information stored in the memory 18 in advance.

When the trailing end of the printing medium is separated from the convey roller 1 after the above-described operation is repeated, the convey amount of the discharge roller 3, which is set to be slightly larger than that of the convey roller 1, is set to be equal to that of the convey roller 1. Subsequently, the discharge roller 3 makes about ⅓ rotation for each line to convey the printing medium until image formation is completed up to the trailing end of the printing medium. Upon completion of image formation, the printing medium is discharged outside the apparatus by a discharge roller pair 21 in FIG. 2.

<Adjustment of Convey Amount>

The above-described operation is an operation to be performed when the apparatus of the embodiment actually forms an image. A sequence of determining the number of drive pulses supplied to each pulse motor for each line will be described below.

When assembly of the apparatus of the embodiment is completed, an image is actually output according to the sequence described above in, for example, the last step in the manufacturing process. For example, an image pattern to be output is a monochrome image and is preferably a lattice-like continuous pattern to measure the convey amount of a printing medium. Data of this print pattern is stored in a ROM beforehand in the apparatus.

As the number of drive pulses, as an initial value, input to each of the motors for driving the convey and discharge rollers 1 and 3, a pulse count (2,000 pulses) corresponding to one rotation of each of the motors is stored in the memory 18. As described above, in the apparatus of the embodiment, when the respective motor drive shafts are rotated once, the convey and discharge rollers 1 and 3 make ⅓ rotation. At this time, the convey amount of a printing medium becomes equal to the print width of the print head according to calculation.

The discharge roller 3 is driven in accordance with the convey amount for each line as an initial value, which is larger than the convey amount of the convey roller 1 by 2%, while the trailing end of a printing medium is held by the convey roller 1. After the trailing end of the printing medium is separated from the convey roller 1, the discharge roller 3 is driven in accordance with the convey amount equal to the print width of the print head according to calculation.

In this state, a lattice pattern is printed on the entire printing medium region, and the convey amount of the printing medium for each line is measured by using a reader or the like on the basis of the pitch of the lattice pattern.

In practice, as shown in FIGS. 5A through 5C, the measured convey amount for each line varies due to the influence of swing of the convey and discharge rollers 1 and 3 or the pulleys 5*a* and 5*b* mounted on the respective roller ends, the influence made when the leading end of the printing medium is brought into contact with the discharge roller 3, and the influence made when the trailing end of the printing medium is separated from the convey roller 1. FIGS. 5A and 5B are tables showing the numbers of drive pulses supplied, as initial values, to the pulse motors 6*a* and 6*b* for the first line to the 12th line, and the differences between the desired convey amounts and the measured convey amounts, recorded when the motors are driven according to the respective pulse counts. FIG. 5C is a graph showing the differences.

When image formation is performed in accordance with the above-described sequence, the rotational displacements of the convey and discharge rollers 1 and 3 relative to the apparatus are constant at the start of image formation on a printing medium. For this reason, the influence of swing of the convey and discharge rollers 1 and 3 and the influences made when a printing medium comes into contact with the rollers or separates therefrom are the same for each printing medium. In addition, the swing of the motor pulleys 7*a* and 7*b* mounted on the pulse motors has no influence on the convey amount of a printing medium because the circumference of each pulley is equal to the print width, as described above.

The two broken curves in FIG. 5C indicate the upper and lower limit data of the feed amount of a printing medium for each line in a case wherein measurement is performed with respect to 10 samples in the above-described state. For the above-described reason, variations in the convey amounts of all printing media for all lines are very small. Therefore, the convey amount of a printing medium for each line can be measured with high precision by performing measurement with respect to only one print sample.

As described above, in the apparatus of the embodiment, the motors 6*a* and 6*b* have a basic step angle of 0.18°, and the convey and discharge rollers 1 and 3 have a circumference three times larger than the print width and are driven by the motors at a reduction ratio of ⅓. Therefore, one pulse input to the pulse motors 6*a* and 6*b* is equivalent to 8.128 μm in terms of the convey amount of a printing medium.

In order to obtain a desired convey amount of a printing medium, the number of drive pulses as an initial value for each line is increased/decreased on the basis of the convey amount of the printing medium for each line, which amount is measured in accordance with the above-described sequence, and the resultant value is stored, as a drive pulse count for each line, in the memory 18.

For example, such a drive pulse count for each motor can be stored in the memory 18 by the following method. A program for writing data in the memory 18 is prepared in advance. A keyboard or the like is connected to an input terminal connected to the CPU 17. Input data is written at a desired address of the memory 18 through the CPU 17.

According to the embodiment, the convey amount of a printing medium is governed by the convey roller 1 until a convey operation immediately before a convey operation of separating the trailing end of the printing medium from the convey roller 1, and is governed by both the convey and discharge rollers 1 and 3 in a convey operation of separating the trailing end of the printing medium from the convey roller 1. In the subsequent convey operations, the convey amount of the printing medium is governed by only the discharge roller 3.

Therefore, in order to increase/decrease the convey amount of a printing medium for the first to ninth lines, the number of drive pulses input to the pulse motor 6*a* is increased/decreased. Similarly, the numbers of drive pulses input to the pulse motors 6*a* and 6*b* are increased/decreased to increase/decrease the convey amount of the printing medium for the 10th line, and the number of drive pulses input to the pulse motor 6*b* for driving the discharge roller 3 is increased/decreased to increase/decrease the convey amount of the printing medium for 11th and subsequent lines.

FIGS. 6A to 6C show drive pulse counts set for the convey and discharge rollers 1 and 3 to realize a constant convey amount, and corresponding convey amounts of a printing medium.

The two broken lines in FIG. 6C indicate the upper and lower limits of the convey amount of a printing medium for each line in a case wherein 10 printing media are conveyed in the above-described state. As shown in FIG. 6C, the convey amount of a printing medium for each line throughout the entire region of the printing medium deviates from a target value by 10 μm or less.

That is, the apparatus of the embodiment, in which the numbers of drive pulses input to the pulse motors 6*a* and 6*b* for each line are stored in the memory 18 in accordance with the above-described sequence, can realize accurate conveyance of a printing medium when a consumer uses the apparatus.

As described above, according to the embodiment, a printing medium can be intermittently conveyed at intervals each equal to the print width, from the leading end to the trailing end, with high precision. Therefore, high-definition images can be output onto the entire region of a printing medium while minimizing the marginal spaces on the leading and trailing ends of an image.

Figure 14:
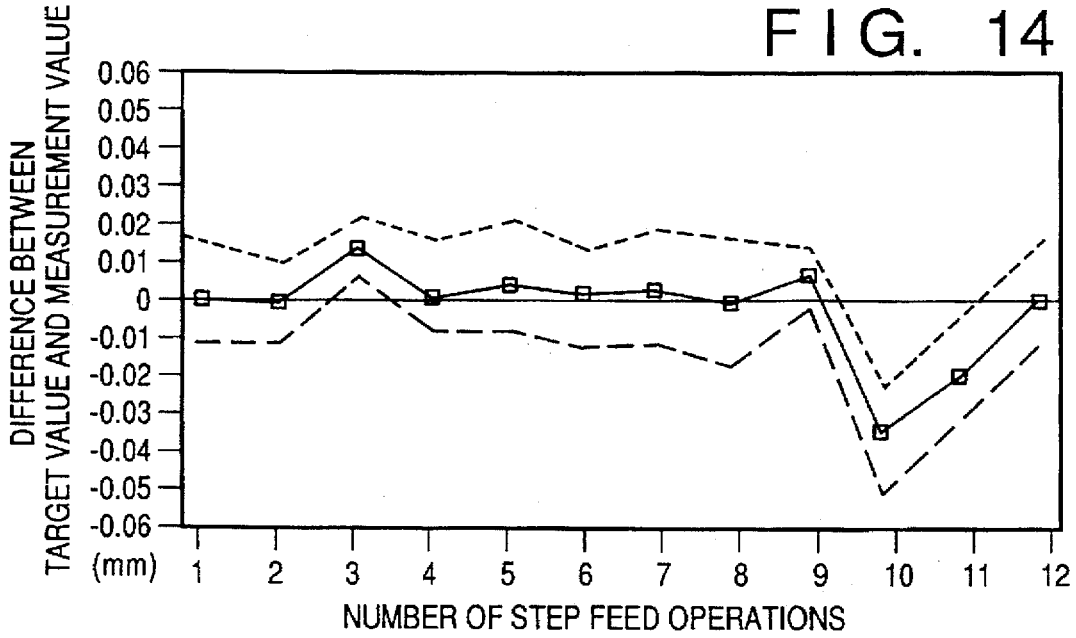
FIG. 14 is a graph showing convey amounts recorded when the convey amount of a printing medium for each line is inaccurate.

FIG. 14 shows the convey amount of a printing medium for each line in a case wherein each printing medium is conveyed in the printing apparatus without restoring the convey and discharge rollers 1 and 3 to predetermined displacements.

That is, the convey and discharge rollers 1 and 3 are driven by the drive pulses shown in FIGS. 5A and 5B, and the rotational displacement of each roller or the like for each printing medium at the start of image formation is not constant.

Note that each of the convey and discharge rollers 1 and 3 is decentered by 10μ, and each of the pulleys inserted in the respective roller ends with pressure is decentered by 10μ.

As described above, even if components processed with very high precision are used, variation in the convey amounts of printing media for the same line reaches ±20μ, as shown in FIG. 14.

This variation occurs because the influence of decentering of each component described above varies for each convey operation.

Referring to FIG. 14, the mean value of the convey amounts of printing media considerably decreases near the 10th line. This is because the number of rollers which govern the conveyance of a printing medium is decreased from two to one, and the conveyance resistance based on suction at the platen portion changes. The mean value reaches about 50μ at worst.

In comparison with this data, it is clear that the printing apparatus of the embodiment can convey a printing medium with high accuracy.

In addition, in the apparatus of the embodiment, since the conveyance precision of a printing medium does not depend on the process precision of pulleys, a convey roller, and the like mounted on motors or roller ends, the manufacturing cost of these components can be greatly reduced.

(Second Embodiment)

The apparatus of the first embodiment is designed such that the rotational displacements of the convey roller and the pulse motor output shaft at the start of image formation are set to be the same for each printing medium.

In the second embodiment to be described next, the relative displacements of transmission means such as pulleys and belts as well as a convey roller and a pulse motor output shaft at the start of image formation are set to be the same for each printing medium.

Figure 9:
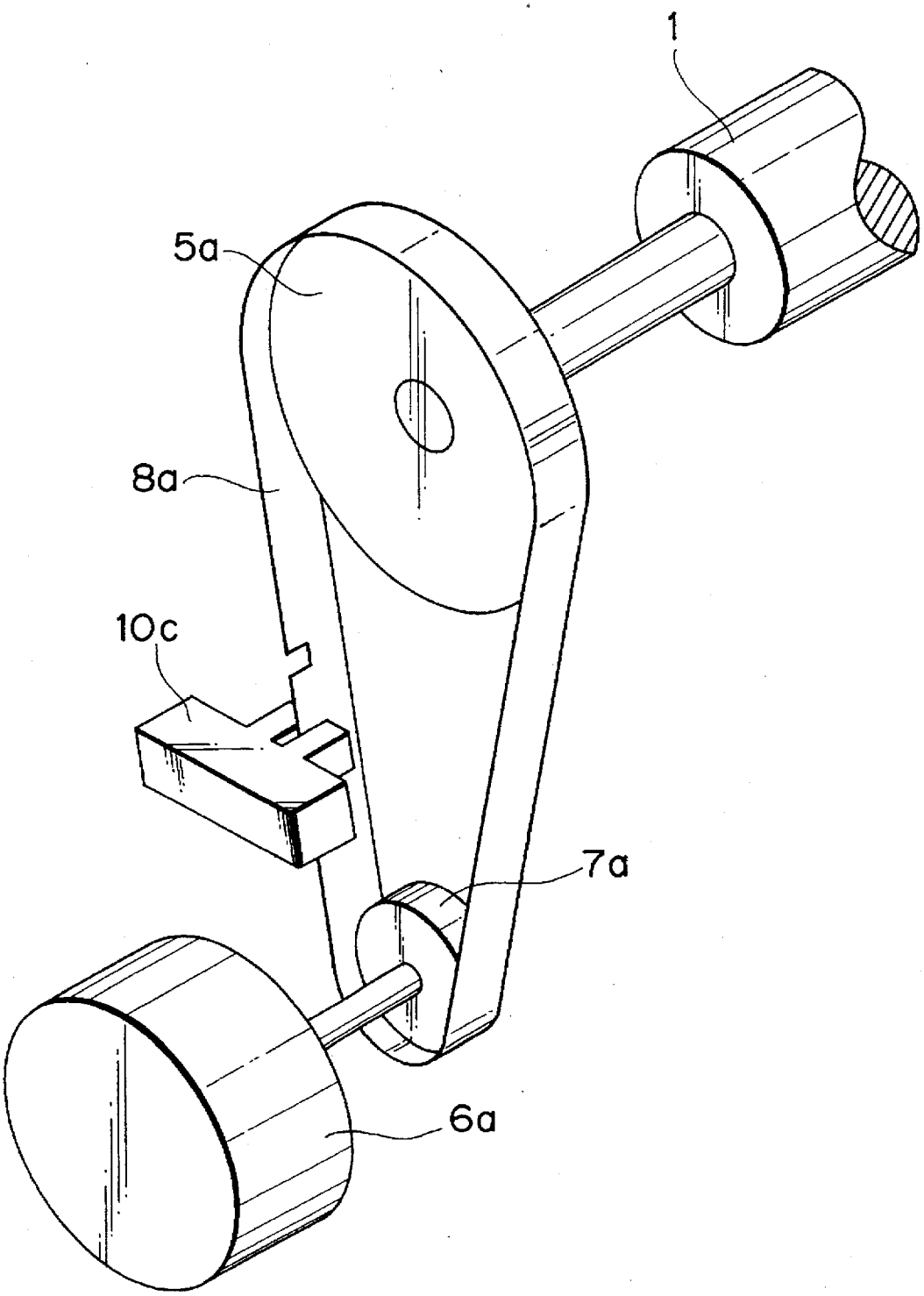
FIG. 9 is a perspective view showing an image forming section of an image forming apparatus according to the second embodiment of the present invention.

FIG. 9 shows part of a printer according to the second embodiment of the present invention. The same reference numerals in FIG. 9 denote the same parts having the same functions as in FIG. 1 showing the printer of the first embodiment, and a description thereof will be omitted.

The arrangement of the apparatus and the operation principle in image formation are almost the same as those in the first embodiment. In the second embodiment, a convey roller 1, a discharge roller 3, and pulse motors 6*a* and 6*b* are restored to the initial states before a printing operation for each printing medium, and belts 8*a* and 8*b* as drive transmission means are also restored to the initial states. For this reason, means for detecting the positions of the belts are arranged. Only the drive section of the convey roller 1 will be described below because the drive sections of the convey roller 1 and the discharge roller 3 are identical.

The apparatus is set such that the ratio of the number of gear teeth of a pulley 7*a* to that of a roller pulley 5*a* is an integer, and the ratio of the number of gear teeth of the roller pulley 5*a* to that of the belt 8*a* is an integer. A slit-like notched portion is formed in the belt 8*a* at a position outside the range in which the belt 8*a* is meshed with the pulleys 5*a* and 7*a*. The pulse motor 6*a* keeps rotating after image formation is completed and the printing medium is discharged outside the apparatus. When the notched portion of the belt 8*a* reaches the position of a photointerrupter 10*c* arranged on the main body side, interruption of a light beam from the photointerrupter 10*c* is canceled. With this operation, a drive pulse stop signal is supplied from a CPU to a motor driver (not shown), thus stopping the driving operation. With this operation, the drive section is restored to an initial state before image formation.

As described above, since the overall drive section can be restored to the initial state by only arranging the means for detecting the positions of the belts, repeatability of the convey amount for each printing operation is improved, thus increasing the conveyance precision of a printing medium in combination of correction of motor drive pulse counts in the first embodiment.

If the ratio of the number of gear teeth of a belt to that of a pulley cannot be set to be an integer because of a problem associated with the arrangement of the apparatus or the like, the flags 9*a* and 9*b* and the photointerrupters 10*a* and 10*b* in the first embodiment are arranged together with the belt position detecting means described above so as to obtain the same effect as described above.

(Third Embodiment)

The third embodiment designed to achieve the same object as that of the second embodiment will be described below.

Figure 10:
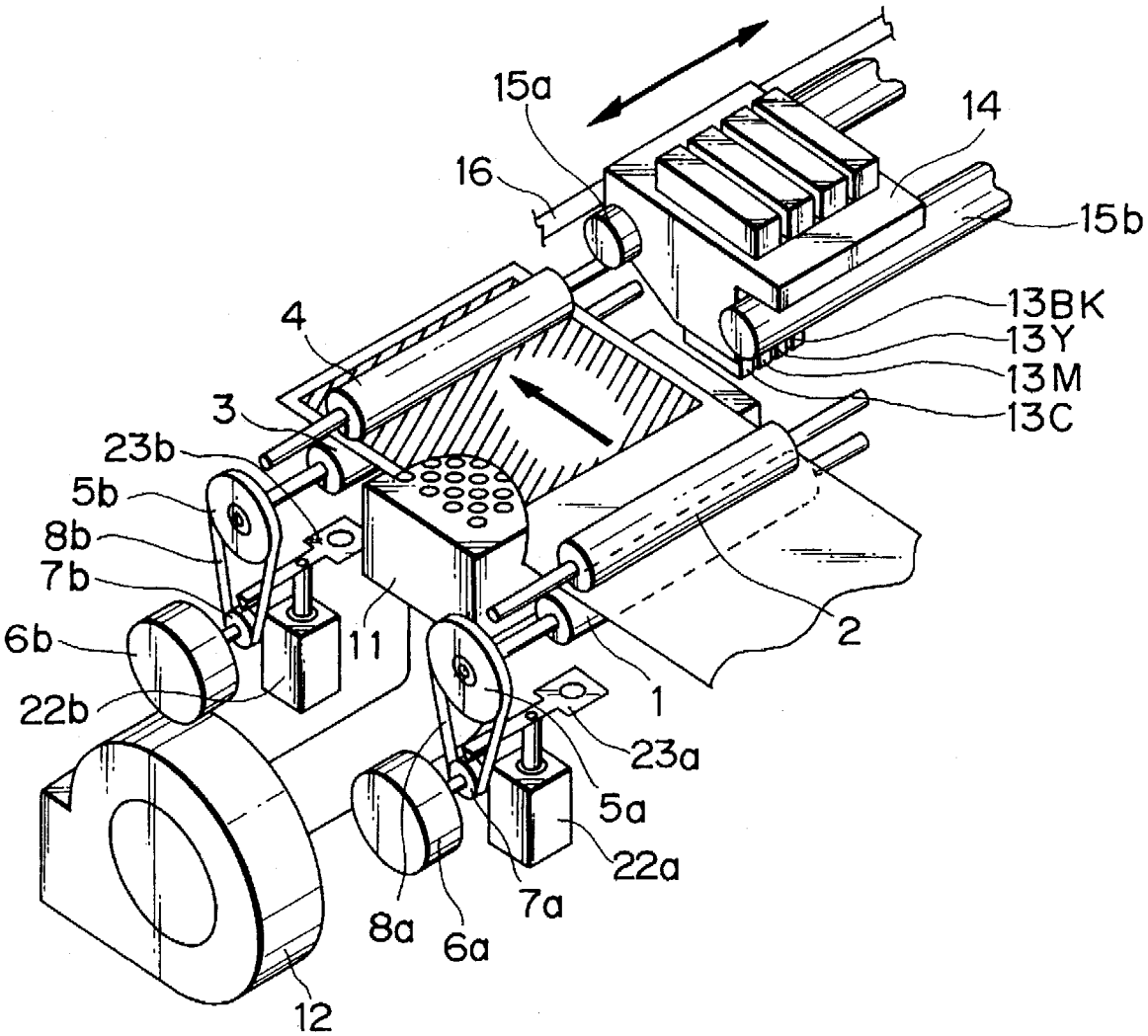
FIG. 10 is a perspective view showing an image forming section of an image forming apparatus according to the third embodiment of the present invention.

FIG. 10 shows the arrangement of an apparatus of the third embodiment. The same reference numerals in FIG. 10 denote the same parts as in FIG. 1, and a description thereof will be omitted. The principle of driving of convey and discharge rollers is the same as that in the first embodiment.

A method of keeping the relative displacement of a convey roller, a transmission belt, and a pulse motor output shaft constant for the sake of image formation on the next printing medium will be described below.

Figure 11:
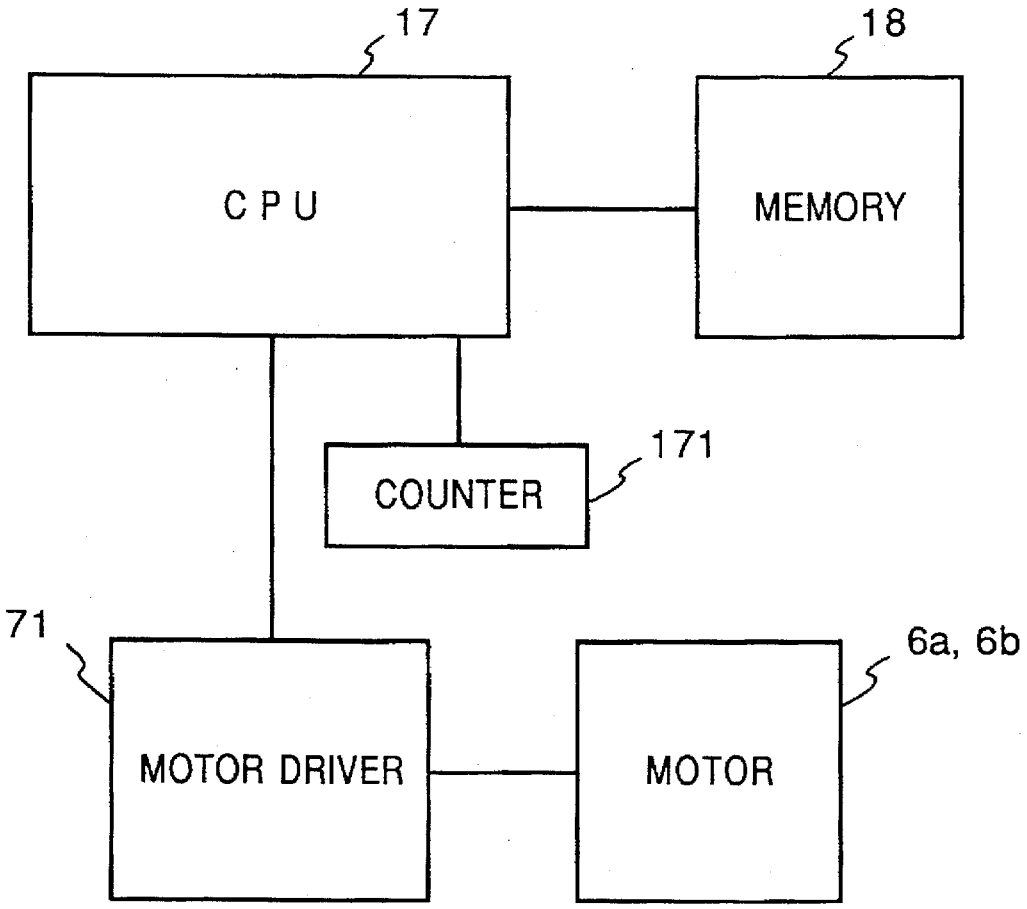
FIG. 11 is a block diagram showing a motor control mechanism of the printer of the third embodiment.

The apparatus of the third embodiment includes a counter for counting drive pulses input to a pulse motor, as shown in FIG. 11. The counter increments the count value when a drive pulse for the rotation direction in an image formation operation is input to a pulse motor 6*a*, and decrements the count value when a drive pulse for a direction opposite to the rotation direction is input. The count value of the counter before an image forming operation is set to be 0, and the pulse count is incremented by the counter in accordance with the number of drive pulses input during an image forming operation. At the same time, the resultant pulse count is stored in a memory.

After the image forming operation, the pulse motor is driven in the direction opposite to the direction in a convey operation of the printing medium until the drive pulse count stored in the memory becomes 0.

In this embodiment, a drive pulse count measured by the counter is always stored in the memory, and the contents of the memory are retained even if the power switch is turned off. When the power switch is turned off, a voltage applied to a solenoid 22*a* is simultaneously interrupted. As a result, a leaf spring 23*a* operates to press a pulley 7*a* so as to restrict the rotational displacement of the pulse motor 6*a*. In addition, a paper sheet jammed in the apparatus can be removed by releasing a driven roller 2, which biases a convey roller, 1 without displacing the convey roller 1, a transmission belt 8*a*, the pulse motor 6*a*, and the like.

When the power switch is turned on, the pulse motor 6*a* is driven until the drive pulse count is set to be 0 (the origin of the pulse motor) by referring to the latest drive pulse count stored in the memory.

By applying the same method to the discharge roller side, image formation on the next printing medium can be performed while keeping the relative displacement of the convey roller 1, the discharge roller 3, the timing belts 8*a* and 8b, and the output shafts of the pulse motors 6a and 6b in the same state as that at the start of the previous image forming operation, even if the numbers of gear teeth of a roller pulley 5a mounted on an end of the convey roller 1, a roller pulley 5b inserted in an end of the discharge roller 3 with a pressure, the timing belts 8a and 8b for driving the respective pulleys, and the motor pulleys 7a and 7b mounted on the pulse motors are not kept in the relationship of an integer multiple.

(Fourth Embodiment)

The fourth embodiment of the present invention will be described next. In the first embodiment, the actual image forming operation and the necessity of determining the number of drive pulses input to each pulse motor for each line have been described. In the fourth embodiment, one example of a sequence of determining each drive pulse count will be described. An image forming operation is the same as that in the first embodiment.

This embodiment is applied to an image printing apparatus having a document reader, e.g., a copying machine or a facsimile apparatus, or an image printing apparatus connected to a document reader through a personal computer.

Figure 12:
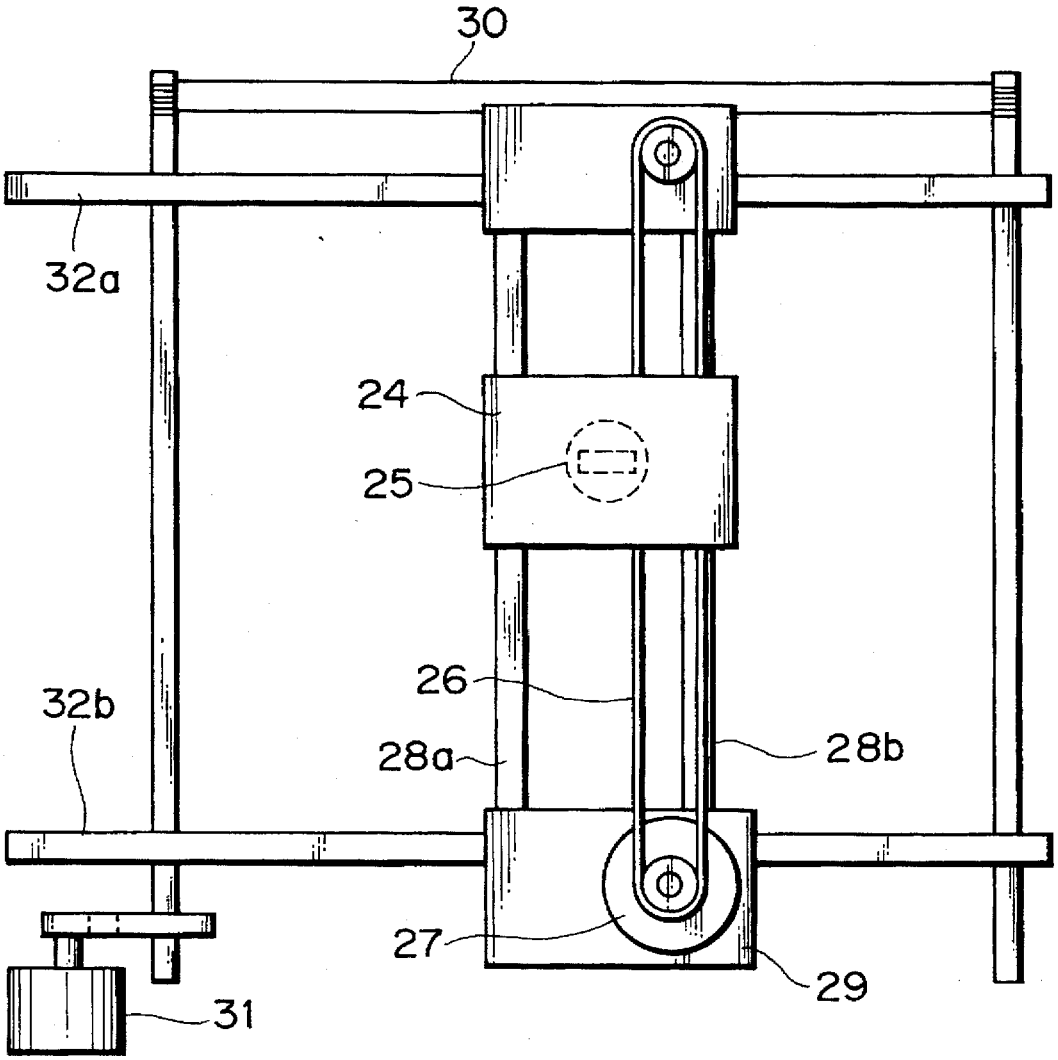
FIG. 12 is a schematic view showing a document reading section of an image forming apparatus according to the fourth embodiment of the present invention.
Figure 13:
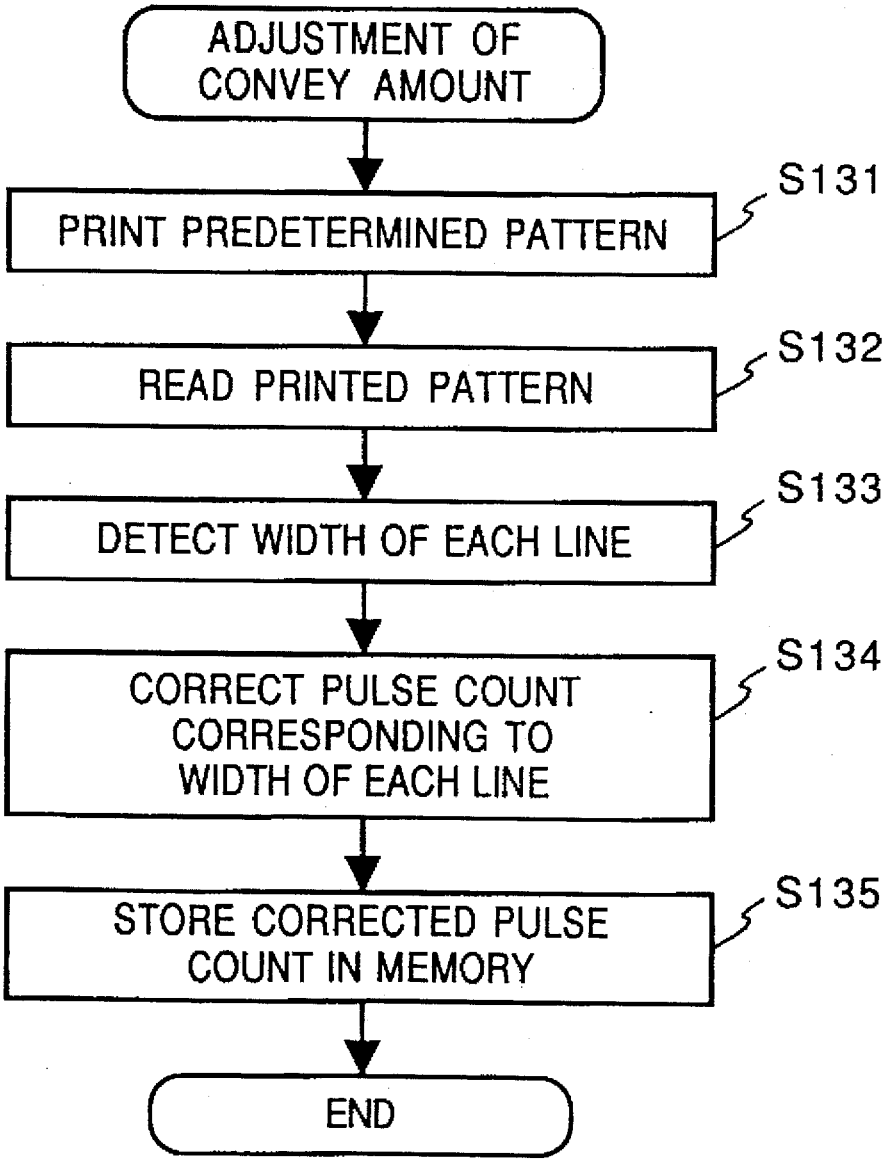
FIG. 13 is a flow chart showing a sequence of convey amount adjustment according to the fourth embodiment.

A copy printing operation of a copying machine using an ink-jet scheme according to the fourth embodiment will be described first. FIG. 12 shows a document reader of the copying machine according to the fourth embodiment of the present invention. FIG. 13 is a flow chart showing a sequence of adjusting the convey amount for each line.

A method of reading a document by using the document reader will be described below. Referring to FIG. 12, a CCD sensor 25, an optical system (not shown), an illumination system (not shown), a printed board (not shown), and the like are mounted on a reader carriage 24. The reader carriage 24 is driven by a motor 27 as a drive source through a drive belt 26 to scan on two rails 28a and 29b. With one scanning operation, a document is read by a pixel width equal to or slightly larger than that of a print head 13. Subsequently, a rail base 29 is driven by a motor 31 through a drive transmission wire 30 to move along rails 32a and 32b in a direction perpendicular to the scanning direction of the reader carriage 24 by an amount corresponding to a print width, thus reading the next line. In the image forming section, printing is performed on a printing medium line by line in accordance with the read information. By repeating this operation, copy printing of the document is performed. Since the details of the image forming method in the image forming section is the same as that in the first embodiment, a description thereof will be omitted.

A sequence of determining the number of drive pulses input to each pulse motor for each line will be described next with reference to FIG. 13.

Similar to the first embodiment, for example, a lattice-like continuous pattern of a monochrome image, which is stored in a ROM in the apparatus to measure the convey amount of a printing medium, is printed on a printing medium. The printing medium having this pattern printed thereon is set on a document table (not shown) of the document reader such that a printing direction on the printing medium is perpendicular to the document reading direction. Subsequently, in step S132, the reader carriage 24 is caused to scan once on a central portion of the printing medium to read the lattice-like pattern in accordance with a sequence of convey amount measurement stored in the ROM. Since the scanning direction of the reader carriage 24 is perpendicular to the scanning direction of the print head 13, the reader carriage 24 can scan from the first print line to the last line with one stroke. In this case, the scanning speed is preferably set to be lower than that in a normal read operation to read the pattern with precision as high as possible. In step S133, the read information is analyzed in an image processing section to obtain a convey amount for each line. That is, variations in the density of the read pattern are checked, and the distance between the adjacent lines are quantized on the basis of the density variations. The convey amount for each line is obtained from these values and the line width.

The differences between the measured convey amounts and the desired convey amounts are converted into drive pulse counts for each pulse motor, and a correction value for the drive pulse count for each line is determined in step S134. In step S135, the respective correction values are stored as a table in a nonvolatile memory. In a subsequent printing operation, a CPU 17 supplies a control signal to each motor driver on the basis of the information of this table, thereby controlling drive pulses input to pulse motors 6a and 6b for driving the respective rollers.

The above-described operation is performed once at the time of shipment or installation of the apparatus. Subsequently, when a component of the convey section, e.g., a convey roller, needs to be replaced for some reason, the above-described operation is performed again after the replacement. With this operation, the drive pulse count table in the memory is updated, and a printing medium can be conveyed again in a desired convey amount. In addition, a change in quality of each roller over time, e.g., wear, can be properly handled.

The present invention can be effectively applied to a printing apparatus of an ink-jet scheme, of the ink-jet printing schemes, in which scattering droplets are formed by using thermal energy to perform a printing operation.

With regard to typical arrangement and principle, for example, a scheme using the basic principle disclosed in U.S. Pat. Nos. 4,723,129 and 4,740,796 is preferable. This scheme can be applied to both a so-called on-demand type apparatus and a continuous type apparatus. The present invention is especially effective for an on-demand type apparatus for the following reason. When one drive signal for providing a rapid increase in temperature exceeding a nucleus boiling temperature in accordance with print information is supplied to a thermoelectric conversion member arranged on a sheet holding a liquid (ink) or in a liquid path, thermal energy is generated in the thermoelectric conversion member to cause film boiling at a heat effect surface of a print head. As a result, a bubble can be formed in the liquid (ink) in one-to-one correspondence with the drive signal. The liquid (ink) is discharged through a discharge opening upon growth and reduction of a bubble, thereby forming at least one droplet. If this drive signal is formed as a pulse-like signal, growth/reduction of a bubble can be quickly and properly performed, which allows discharging of the liquid (ink) with excellent response characteristics. Therefore, it is preferable that the drive signal be formed as a pulse-like signal.

As this pulse-like drive signal, a signal such as the one disclosed in U.S. Pat. Nos. 4,463,359 and 4,345,262 is suitable. Note that excellent printing can be performed by using the conditions described in U.S. Pat. No. 4,313,124 associated with the rate of temperature rise at the above-mentioned heat effect surface.

As an arrangement for a print head, in addition to the arrangement described above, in which the discharge opening, the liquid path, and the thermoelectric conversion member are combined (a straight liquid path or a right angle liquid path), the arrangement disclosed in U.S. Pat. Nos. 4,558,333 and 4,459,600 in which a heat effect surface is arranged at a bent region may be employed.

In addition, the arrangement disclosed Japanese Patent Laid-Open No. 59-123670 in which a slit common to a plurality of thermoelectric conversion member is used as the discharge portion of a thermoelectric conversion member or the arrangement disclosed in Japanese Patent Laid-Open No. 59-138461 in which an opening for absorbing pressure waves of thermal energy is arranged in correspondence with a discharge portion may be employed.

As a full-line type print head having a length corresponding to the width of a maximum-size printing medium on which the printing apparatus can print an image, either an apparatus having a plurality of print heads combined to satisfy the length requirement, as described above, or an apparatus having a single integral print head may be used.

Furthermore, an exchangeable chip type print head which can be electrically connected to the apparatus main body and allows supply of an ink from the apparatus main body, or a cartridge type print head having an ink tank integrally formed thereon may be used.

A recovery means, a preliminary auxiliary means, and the like are preferably added to a print head arranged as a component of the printing apparatus of the present invention in order to further stabilize the effects of the present invention. For example, a capping means for the print head, a cleaning means, a pressurizing or suction means, a preliminary heating means constituted by a thermoelectric conversion means or another type of heating element or a combination thereof, and a means for performing a preliminary discharge mode different from a discharge mode in a printing operation are effective for a stable printing operation.

In addition to the print mode using only a main color such as black, the printing apparatus may include at least one of color modes, i.e., a multi-color mode using different colors and a full-color mode using color mixtures.

In the above-described embodiments of the present invention, an ink is handled as a liquid. However, an ink which is solidified at room temperature or less and is softened or liquified at room temperature may be used, or any type of ink which is liquified when the current print signal is applied may be used because in the above-described ink-jet scheme, temperature control is generally performed by performing temperature adjustment of an ink itself within the range of 30° C. to 70° C. to set the viscosity of the ink within a stable discharge range.

Furthermore, a rise in temperature due to thermal energy may be positively prevented by using the thermal energy as energy for a state change from a solid to a liquid, or an ink which is solidified when it is left to stand may be used to prevent evaporation of the ink. In any case, an ink which is liquified to be discharged as a liquid ink upon application of thermal energy in accordance with a print signal, or an ink which is liquified only by thermal energy, e.g., an ink which starts to solidify when it reaches a printing medium, may be used in the present invention. In such a case, as disclosed in Japanese Patent Laid-Open Nos. 54-56847 and 60-71260, an ink may be held as a liquid or a solid in a porous sheet recess or through hole to oppose a thermoelectric conversion member. In the present invention, execution of the above-described film boiling scheme is most effective for each ink described above.

Moreover, the printing apparatus according to the present invention may take various forms. For example, the apparatus may be integrally or separately arranged as an image output terminal of an information processing apparatus such as a word processor or a computer, as described above, or may take the form of a copying machine combined with a reader or the like. Alternatively, the apparatus may take the form of a facsimile apparatus having a transmission/reception function.

The present invention is not limited to the above embodiments and various changes and modifications can be made within the spirit and scope of the present invention. Therefore, to apprise the public of the scope of the present invention, the following claims are made.

What is claimed is:

1. An image forming apparatus for forming an image on a printing medium, which prints an area, by printing means, having predetermined length along the conveying direction of the printing medium and conveys the printing medium by a conveying distance corresponding to the predetermined length, repeatedly, comprising:

convey means, which includes rollers contactable with the printing medium and driving means to rotate the rollers, for conveying the printing medium by rotating the rollers;

setting means for setting each of an angular position of each roller and a position of the printing medium along the conveying direction to predetermined positions; and storage means for storing predetermined drive-amount data of said driving means corresponding to each angular position of the rollers, so as to convey the printing medium by the conveying distance at each angular position of the rollers, wherein said driving means rotate the rollers from the angular position set by said setting means to convey the printing medium by the conveying amount of the basis of the drive-amount data stored by said storage means.

2. An apparatus according to claim 1, wherein said driving means includes motors and said convey means includes transmitting means for transmitting a rotational force of said motors to said rollers, and the angular position of each roller indicates a position on a circumferential portion of each of said motors.

3. An apparatus according to claim 2, wherein a ratio of a rotational speed of said roller to that of said motor is an integer.

4. An apparatus according to claim 1, further comprising means for storing a predetermined image pattern, so that the predetermined image pattern is formed on the printing medium, and the drive amount data stored in said storage means is updated on the basis of the image.

5. An apparatus according to claim 1, wherein said convey means includes a pulse motor, said drive means includes a counter for counting drive pulses applied to said pulse motor in accordance with a rotation direction, and said setting means drives said pulse motor such that a count value of said counter becomes a predetermined value.

6. An apparatus according to claim 1, further comprising reading means for reading a document having a plurality of lines, so that an image printed by said printing means is read by said reading means to measure a convey amount for each line, and the drive amount data stored in said storage means is updated on the basis of the convey amount for each line.

7. An apparatus according to claim 1, wherein said printing means includes an ink-jet printing head for performing a printing operation by discharging an ink.

8. An apparatus according to claim 1, further comprising a printing head for discharging an ink by using thermal energy, wherein said printing head includes a thermal energy conversion member for generating thermal energy supplied to the ink.

9. An apparatus according to claim 1, wherein a total conveyed distance of the printing medium is n-times (n is an integer number) the conveying distance of a single rotation of the rollers.

10. An apparatus according to claim 9, wherein said storage means stores the drive-amount data corresponding to each of n-time-conveying distance of the printing medium conveyed from the position set by said setting means.

11. An apparatus according to claim 1, wherein said driving means includes pulse motors driven by electrical pulse, and said storage means stores a number of pulses to be inputted to the pulse motors as the drive-amount data.

12. An apparatus according to claim 11, wherein said conveying means includes pulleys and belts and the rollers are driven by the pulse motors via the pulleys and belts.

13. An apparatus according to claim 1, further comprising detection means for detecting angular positions of the rollers, wherein said setting means sets the positions of the rollers to the predetermined positions based on the detected position by said detection means.

14. An apparatus according to claim 1, wherein the drive-amount data stored by said storage means corresponds to the predetermined conveying distance of the printing medium so as to correct non-uniformity of conveying amount caused by eccentricity of the rollers, which corresponds to a predetermined rotating amount of the rollers.

15. A printing medium conveying method for an image forming apparatus which prints an area having predetermined length along the conveying direction of the printing medium and repeatedly conveys the printing medium by a conveying distance corresponding to the predetermined length by conveying means, wherein said convey means includes rollers contactable with the printing medium and driving means to rotate the rollers, and conveys the printing medium by rotating the rollers, comprising the steps of:

setting each of an angular position of each roller and a position of the printing medium along the conveying direction to predetermined positions; and driving said driving means to rotate the rollers from an angular position set in said setting step to convey the printing medium by the predetermined conveying distance on the basis of the drive-amount data corresponding to conveying amount at each angular position of the rollers.

16. A method according to claim 15, wherein the drive-amount data is stored by the image forming apparatus.

17. A method according to claim 16, wherein a total conveyed distance of the printing medium is n-times (n is an integer number) the conveying distance of a single rotation of the rollers.

18. A method according to claim 17, wherein the image forming apparatus stores the drive-amount data corresponding to each of n-time-conveying distance of the printing medium conveyed from the position set in said setting step.

19. A method according to claim 15, wherein said driving means includes pulse motors driven by electrical pulse, and a storage means stores a number of pulses to be inputted to the pulse motors as the drive-amount data.

20. A method according to claim 19, wherein said convey means includes pulleys and belts and the rollers are driven by the pulse motors via the pulleys and belts.

21. A method according to claim 15, further comprising detecting step for detecting angular positions of the rollers, wherein the positions of the rollers are set to the predetermined positions in said setting step based on the detected position detected in said detecting step.

22. A method according to claim 15, wherein the drive-amount data corresponds to the predetermined conveying distance of the printing medium so as to correct non-uniformity of conveying amount caused by eccentricity of the rollers, which corresponds to a predetermined rotating amount of the rollers.

23. A method according to claim 15, wherein the image forming apparatus includes an ink-jet printing head for performing a printing operation by discharging an ink.

24. A method according to claim 15, wherein the image forming apparatus includes a printing head for discharging an ink by using thermal energy, and includes a thermal energy conversion member for generating thermal energy supplied to the ink.

25. A sheet conveying apparatus comprising:

convey means for conveying a sheet in a predetermined direction, said convey means comprising a first conveying roller and a second conveying roller, wherein the first and second conveying rollers are provided at a predetermined distance from each other in the predetermined direction, and each of which has contact with the sheet and conveys the sheet by rolling;

first and second drive means for rotating the first and second conveying rollers, respectively;

storage means for storing drive-amount data for said first and second driving means;

setting means for setting a position of the sheet along the conveying direction to a predetermined position and each of an angular position of the first and second conveying rollers to a predetermined position; and control means for controlling a drive-amount, corresponding to a predetermined conveying amount, of the first and second driving means from each angular position of the first and second conveying rollers set by said setting means to convey the sheet on the basis of the drive-amount data stored by said storage means.

26. The sheet conveying apparatus according to claim 25, further comprising:

first detecting means for detecting an angular position of the first conveying roller; and second detecting means for detecting an angular position of the second conveying roller, wherein said control means controls the first and second conveying rollers to rotate to a predetermined angular position in advance of sheet conveyance.

27. The sheet conveying apparatus according to claim 25, wherein said control means controls respective rotational amounts, corresponding to a predetermined conveying amount, of the first and second conveying rollers, based on whether a sheet is conveyed by the first conveying roller or the second conveying roller.

28. The sheet conveying apparatus according to claim 27, wherein said control means controls respective rotational amounts of the first and second conveying rollers at a transmission stage from a state where a sheet is conveyed by the first and second conveying rollers to a state where a sheet is conveyed by the second conveying roller.

29. The sheet conveying apparatus according to claim 25, further comprising:

a first supporting roller, pressing the sheet against said first conveying roller, which rotates in accordance with rotation of said first conveying roller and with conveyance of the sheet; and a second supporting roller, pressing the sheet against said second conveying roller, which rotates in accordance with rotation of said second conveying roller and with conveyance of the sheet.

30. The sheet conveying apparatus according to claim 29, wherein respective forces pressing the first and second supporting rollers against the first and second conveying rollers are different.

31. The sheet conveying apparatus according to claim 25, wherein said convey means comprises a first pulse motor for driving said first conveying roller and a second pulse motor for driving said second conveying roller.

32. The sheet conveying apparatus according to claim 31, wherein said first and second conveying rollers are driven by rotational motion of said first and second pulse motors, and where the motion is transmitted via belts.

33. The sheet conveying apparatus according to claim 32, further comprising belt position detecting means for detecting a position of the belt.

34. The sheet conveying apparatus according to claim 33, wherein said control means drives said first and second pulse motors until the belts reach predetermined positions in advance of sheet conveyance.

35. The sheet conveying apparatus according to claim 33, further comprising count means for counting numbers of pulses for driving said first and second pulse motors, wherein said control means controls said first and second pulse motors to rotate in reverse direction of conveying direction of the sheet until numbers counted by said count means become zeros in advance of sheet conveyance.

36. A sheet conveying method for conveying a sheet by convey means having a first conveying roller and a second conveying roller driven by first and second driving means respectively, where the first and second conveying rollers are provided at a distance from each other and convey a sheet by rolling contact with the sheet, comprising the steps of:

setting a position of the sheet along the conveying direction to a predetermined position and each of an angular position of the first and second conveying rollers to predetermined positions; and controlling a drive-amount, corresponding to a predetermined conveying amount, of the first and second driving means on the basis of a predetermined drive-amount and each of the predetermined positions set by said setting step.

37. The sheet conveying method according to claim 36, further comprising the step of storing rotational amount data for the first and second conveying rollers, wherein said control means controls the rotational amounts of the first and second conveying rollers on the basis of the rotational amount data stored by said storage means.

38. The sheet conveying method according to claim 36, further comprising the step of:

detecting an angular position of the first conveying roller; and detecting an angular position of the second conveying roller, wherein said control means controls the first and second conveying rollers to rotate to predetermined angular position in advance of sheet conveyance.

39. The sheet conveying method according to claim 36, wherein the control of respective rotational amounts, corresponding to a predetermined conveying amount, of the first and second conveying rollers, is based on whether a sheet is conveyed by the first conveying roller or the second conveying roller.

40. The sheet conveying method according to claim 39, wherein the control of respective rotational amounts of the first and second conveying rollers is at a transmission stage from a state where a sheet is conveyed by the first and second conveying rollers to a state where a sheet is conveyed by the second conveying roller.

41. The sheet conveying method according to claim 36, further comprising:

rotating a first supporting roller, pressing the sheet against said first conveying roller, in accordance with rotation of said first conveying roller and with conveyance of the sheet; and rotating a second supporting roller, pressing the sheet against said second conveying roller, in accordance with rotation of said second conveying roller and with conveyance of the sheet.

42. The sheet conveying method according to claim 41, wherein respective forces pressing the first and second supporting rollers against the first and second conveying rollers are different.

43. The sheet conveying method according to claim 36, wherein the convey means comprises a first pulse motor for driving said first conveying roller and a second pulse motor for driving said second conveying roller.

44. The sheet conveying method according to claim 43, wherein the first and second conveying rollers are driven by rotational motion of said first and second pulse motors, and where the motion is transmitted via belts.

45. The sheet conveying method according to claim 44, further comprising the step of detecting a position of the belt.

46. The sheet conveying method according to claim 45, wherein rotational amounts are controlled by driving the first and second pulse motors until the belts reach predetermined positions in advance of sheet conveyance.

47. The sheet conveying method according to claim 45, further comprising the step of counting numbers of pulses for driving said first and second pulse motors, wherein rotational amounts are controlled by driving the first and second pulse motors to rotate in reverse direction of conveying direction of the sheet until numbers counted during said counting steps become zeros in advance of sheet conveyance.

48. The sheet conveying method according to claim 36, wherein said control step comprises the steps of:

conveying the sheet by controlling the first conveying roller to rotate until a top edge of the sheet reaches the second conveying roller;

controlling both the first and second conveying rollers to rotate after the top edge of the sheet reaches the second conveying roller until a rear edge of the sheet leaves the first conveying roller, and conveying a sheet by rotation of the first conveying roller; and conveying the sheet by controlling the second conveying roller to rotate after the rear edge of the sheet leaves the first conveying roller, wherein at least one conveying roller of the first and second conveying rollers which is conveying the sheet is controlled so that its rotational amount corresponds to the predetermined conveying amount.

* * * * *

UNITED STATES PATENT AND TRADEMARK OFFICE

CERTIFICATE OF CORRECTION

PATENT NO. : 5,674,019
DATED : October 7, 1997
INVENTOR(S) : Atsushi MUNAKATA, et al.

It is certified that error appears in the above-identified patent and that said Letters Patent is hereby corrected as shown below:

Column 18, line 40, delete "steps" and insert therefor --step--.

Signed and Sealed this

Twenty-fifth Day of August, 1998

Bruce Lehman

*Attest:*

BRUCE LEHMAN

*Attesting Officer*

*Commissioner of Patents and Trademarks*